United States Patent [19]

Lindgren

[11] Patent Number: 4,522,379

[45] Date of Patent: Jun. 11, 1985

[54] SKI HOLDER

[76] Inventor: Erik V. Lindgren, P1 1101, S-790 15 Sundborn, Sweden

[21] Appl. No.: 468,690

[22] Filed: Feb. 22, 1983

[30] Foreign Application Priority Data

Feb. 23, 1982 [SE] Sweden ..... 8201125

[51] Int. Cl.[3] ..... B25B 1/20

[52] U.S. Cl. ..... 269/47; 269/97; 269/906

[58] Field of Search ..... 269/43, 906, 47, 48.1, 269/82, 97, 98, 152; 224/917; 280/809, 607, 814; 12/124, DIG. 3

[56] References Cited

U.S. PATENT DOCUMENTS 473,654 4/1892 Brigham ..... 12/124

3,838,866 10/1974 D'Alessio ..... 280/607

3,977,663 8/1976 Kohler et al. ..... 269/906

FOREIGN PATENT DOCUMENTS 450272 9/1927 Fed. Rep. of Germany ..... 269/97

*Primary Examiner*—Robert C. Watson

*Attorney, Agent, or Firm*—Bacon & Thomas

[57] ABSTRACT

A holder for attaching a ski having a binding including a ski-stopper to a stationary support comprises a ski boot dummy to be inserted into the ski binding while retracting the ski stopper mechanism. A holder part has means for attachment to the stationary support, and means for removably securing said dummy to said holder part. The holder can hold the ski in a first position, with the bottom side of the ski up, and second and third positions with either of the ski side edges up, thus permitting preparation of the running surface (waxing, etc.) as well as both side edges (sharpening, etc.).

5 Claims, 5 Drawing Figures

SKI HOLDER

Figure 1:
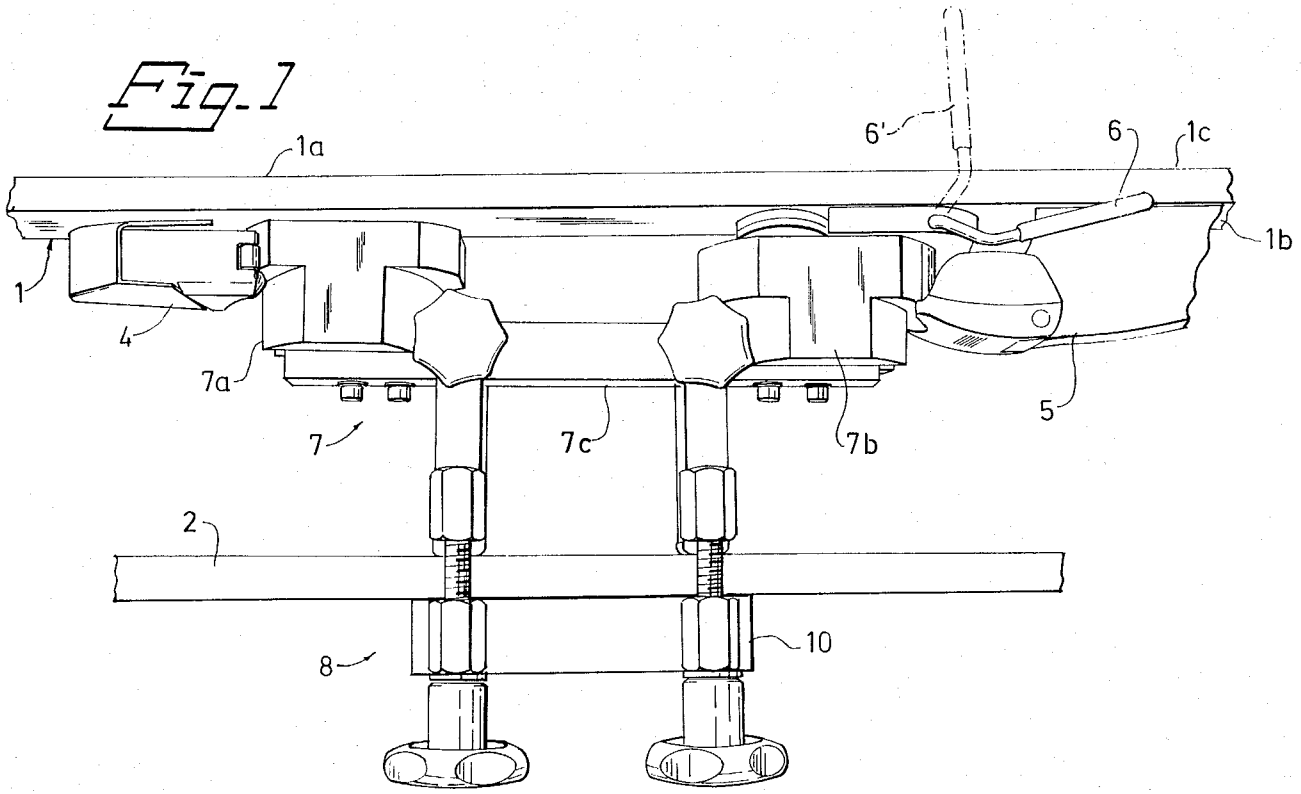

The present invention relates to an improved ski holder, i.e. a device for steadily holding a ski to a stationary support, e.g. a work top, for permitting preparation of the ski, such as waxing, edge sharpening, etc. The ski holder according to the invention is primarily intended for downhill type skis and the like, in which bindings are used, which provide an essentially rigid connection between the ski boot and the ski. The ski holder according to the invention is especially suitable for downhill skis of the type in which a so-called ski stopper is automatically released when the ski loosens from the ski boot, thereby preventing the ski from gliding.

In order to function well slalom skis and other downhill type skis require careful treatment in the form of waxing, sharpening of the steel edges, trimming of the running surface, etc. Such treatment has to be done comparatively often. In order to obtain an acceptable result it is required that the ski can be kept steadily secured and that one can work freely with both hands. To achieve this has proven to be a difficult problem, and prior art solutions have several drawbacks. These prior solutions are usually based on some kind of clamping devices, which clamp the ski from the side edges. One drawback of these constructions is that skis of this type are too thin for being clamped in such manner, the result often being that the ski loosens and/or is damaged. Another essential drawback of these prior art devices is that the ski stopper projecting from the sliding surface forms an obstacle for the preparation. With the conventional holders there is also a risk that i.a. the hands of the operator can be damaged during the preparation. Further, the presently available holders require planar, straight and parallel supporting points for obtaining a stable fixation of the ski.

Swedish Pat. No. 7513771-1 (Publication No. 395,368) discloses a ski holder, which makes use of the ski binding for securing the ski in a position with the running surface turned upwards. The top portion of the holder is designed as a ski boot sole dummy comprising a toe part and a heel part. These two parts form the respective top portion of two stands, which are mounted on a common bottom plate, which is to be secured to the stationary support by means of a separate cramp or the like, which thus does not form an integrated part of the ski holder device. This patent is said to relate to both downhill skis and cross-country skis, although no ski stopper mechanism is disclosed or shown. The distance between the toe and heel parts can be adjusted, but there is no possibility of securing the ski in any position other than with the running surface facing upwards, which is a major disadvantage.

It is an object of the present invention to provide a ski holder which removes the above and other drawbacks of the prior art ski holders.

A particular object of the invention is to provide a ski holder for downhill type skis, in which the ski in very simple manner can be firmly held in, and rapidly changed between, three different working positions, viz. one in which the running surface is directed upwards and two in which either of the side edges is directed upwards.

In its broadest aspect the ski holder according to the invention comprises a ski boot dummy which is designed to be attached in the ski binding corespondingly as a regular ski boot, the ski boot dummy having suitable means for attachment to any desired stationary support. By using the binding of the ski for the attachment of the ski holder, the hindering effect of the ski stopper mechanism is eliminated—it is retracted when the dummy is attached to the binding—and the underside of the ski as well as its two side edges are free for preparation, which thus can be performed unhindered and in optimal manner.

According to a preferred embodiment the ski boot dummy comprises a front part corresponding to the toe part of a ski boot, a rear part corresponding to the heel part of a ski boot, and an intermediate part interconnecting the front part with the rear part. It is preferred that the intermediate part is removably attachable to a holder part, which further is provided with means for securing the holder to a stationary support element or a support surface, such as a work top, a fence, a hand rail, or the like. According to an especially preferred embodiment the intermediate part has quadrilateral, in particular essentially square cross-sectional shape, the holder part preferably comprising two spaced apart holder elements or holder legs, each of which is provided with a recess of a shape corresponding to the shape of the intermediate part and being intended to receive said part for securing the same in the respective recess. In this embodiment the intermediate part can, without any change whatsoever of the adjustment relative to the ski binding, in very simple manner be secured in the holder part in three different positions, in which the bottom side of the ski and its two side edges respectively are turned upwards and are free and easily available for preparation.

Figure 2:
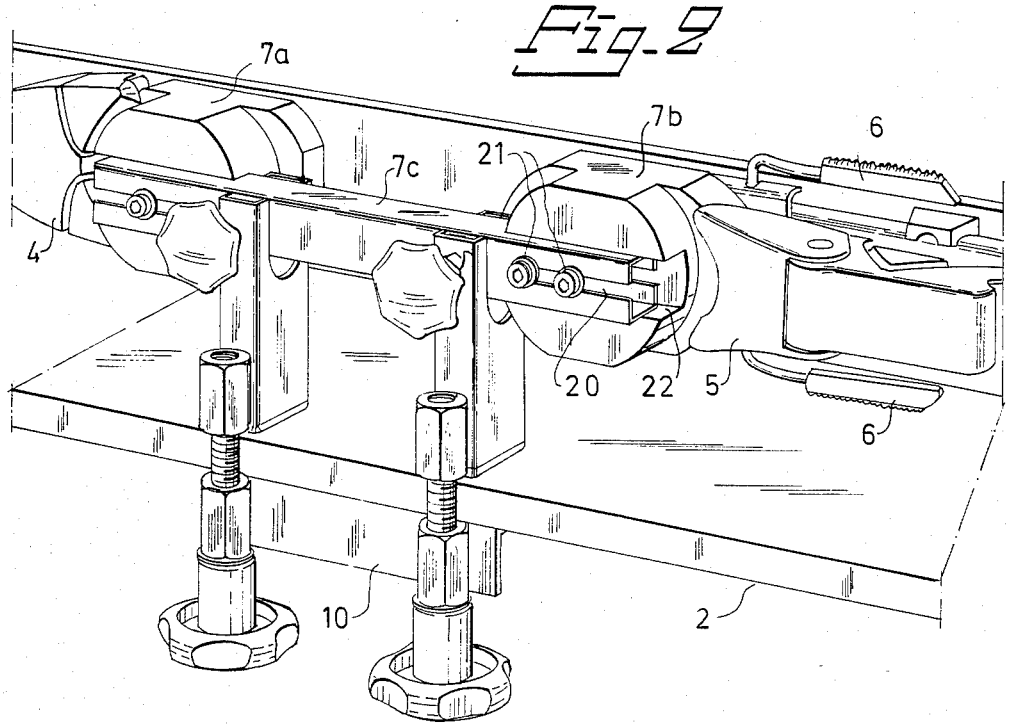
Figure 4:
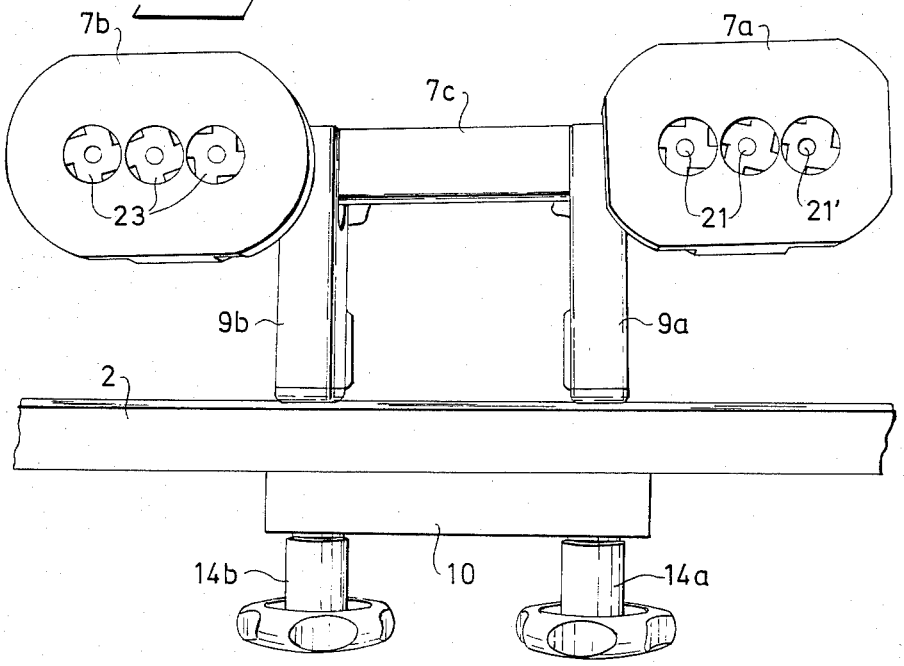
Figure 3:
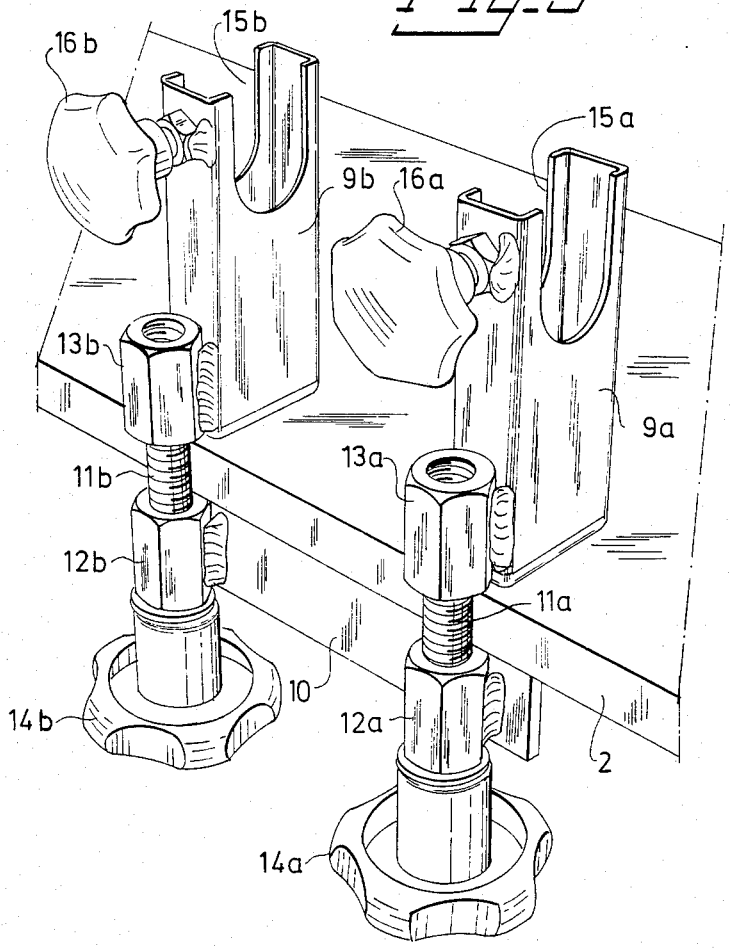
Figure 5:
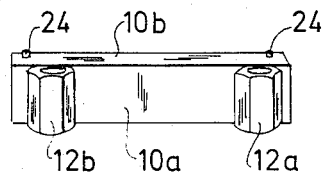

The above and other objects, characteristics and advantages of the ski holder according to the invention will appear in more detail from the following description of a preferred embodiment thereof, reference being made to the enclosed drawings, wherein FIG. 1 is a side-elevation view of the ski holder according to the invention mounted with the bottom side up for preparation of the running surface, FIG. 2 is a perspective view of the ski holder of FIG. 1 with the ski mounted with one side edge up for preparation thereof, FIG. 3 is a perspective view of the holder part of the ski holder according to the invention, FIG. 4 is a side-elevation view of the ski holder according to the invention mounted in the position of FIG. 2, but without attached ski, and FIG. 5 is a perspective view of the clamping piece of the holder part.

FIG. 1 shows a ski 1, which is secured to a stationary support 2 (such as a work top) by means of a holder according to the invention. The ski 1 has a conventional binding with a toe portion 4, a heel portion 5 and a ski stopper 6 which is in the retracted position when a ski boot or—as in the invention—a ski boot dummy is inserted into the binding, but which automatically projects to the stopper position 6' (broken lines) when the ski boot/ski boot dummy is removed from the binding.

The ski holder according to the invention essentially consists of a ski boot dummy 7 and a holder part 8. The dummy 7 comprises a front part *7a*, a rear part *7b* and an intermediate part *7c*. The front part *7a* and the rear part *7b* are functionally similar to the toe portion and heel portion respectively of a corresponding ski boot, so that they can be inserted into the binding 4, 5 correspondingly as the ski boot, while retracting the ski stopper mechanism to the position 6. The binding can, for example, be of the step-in-type or the Rotamatic type. The term "functionally similar" only means that the front and rear parts *7a* and *7b*, when inserted into the binding, cause the same to perform its normal function, i.e to retract the ski stopper and hold the ski boot dummy in the binding. Said term does not mean that the dummy has to look like a ski boot.

In the illustrated preferred embodiment the intermediate piece *7c* has essentially square cross-sectional shape, and it can e.g. consist of a square profiled tube. The holder 8 preferably has the design which is best shown in FIG. 3. The holder part shown therein essentially consists of two holder legs 9*a* and 9*b*, which are interconnected by means of a clamping piece 10 and two fastening screws 11*a* and 11*b*. The fastening screws 11*a*, 11*b* extend through guide sleeves 12*a*, 12*b* carried by the clamping piece 10, and they are screwed into internally threaded pieces 13*a* and 13*b* respectively on the holder legs 9*a* and 9*b* respectively. At the opposite end the screws 11*a*, 11*b* are provided with suitable tightening knobs 14*a* and 14*b* respectively.

The holder legs 9*a*, 9*b* are provided with recesses 15*a*, 15*b* for receiving the intermediate piece *7c* of the ski boot dummy 7. The width of these recesses 15*a*, 15*b* is preferably only somewhat greater than the side edge of the square tube *7c*, so that the same can be inserted into the recesses with only a small play. The intermediate piece 7 is fixed in the recesses 15*a*, 15*b* by means of clamping screws 16*a* and 16*b* respectively. The attachment to the support surface 2 takes place between the bottom parts of the holder legs 15*a*, 15*b* and the clamping piece 10, by tightening the screws 11*a*, 11*b* into the threaded pieces 13*a*, 13*b*. For strength reasons the bottoms of the recesses 15*a*, 15*b* are not square, but rounded.

The ski holder according to the invention can rapidly, conveniently and reliably be adjusted to different binding sizes (boot sizes). To this end the two dummy parts *7a* and *7b* are displacable along the intermediate portion *7c* and can be secured in arbitrary positions along the same. One preferred manner of achieving this adjustability is best illustrated in FIGS. 2 and 4. In this embodiment the intermediate portion *7c* is at its ends provided with longitudinal slots 20 for fixing screws 21 for securing the dummy parts *7a* and *7b* to the intermediate piece *7c*. The size of the dummy, i.e. the distance from the front edge of the toe portion 7 to the rearmost edge of the heel portion *7b*, is adjusted by moving the respective dummy part along the slots 20 whereupon the screws 21 are tightened in the desired position. The dummy parts *7a* and *7b* are preferably provided with guiding grooves 22 of corresponding shape as the intermediate piece *7c*. In the shown embodiment two screws 21 are used for each dummy part, and these screws cooperate with corresponding nuts 23 embedded in the bottom side of the dummy part. It may in certain instances be desirable not to make the slots 20 too long, and in order to increase the useful size range the dummy parts *7a*, *7b* can be provided with a further screw hole 21', as shown in FIG. 4. The ski boot dummy shown in FIG. 4 can thus be shortened by utilizing the mid-screw 21 and the outer screw 21' (instead of the two inner screws 21) for either or both of the dummy parts *7a* and *7b*. The fixing screws 21 are for simplicity reasons suitably of the Allen screw type.

In an alternative embodiment the slots 20 are closed at their outer ends, and the screws 21 (21') are replaced by one single screw, which can be inserted through at least one hole provided in the dummy part *7a*, *7b* preferably three holes positioned along the dummy part like the holes for the screws 21, 21' in FIGS. 2 and 4. The head of the single screw is located at the dummy bottom side and performs a similar function as the nuts 23. The screw passes through the dummy part and the slots 20, and its free end engages with a correspondingly internally threaded knob (similar to knobs 16*a*, 16*b*). The adjustment is done essentially as in the embodiment shown in FIGS. 2 and 4, but it is simplified by the use of only one fixing screw and a knob nut in place of the Allen type fixing screws 21, 21'. Using "closed" slots 20 gives the advantage that the ski boot dummy parts *7a*, *7b* always are retained by the intermediate part *7c* also when loosened for adjustment.

When using the ski holder according to the invention the size of the dummy is at first adjusted to the size of the binding in the manner just described (by means of the screws 21 and the slot 20), and the dummy is then pushed into the binding. The intermediate piece—or profiled tube —*7c* is secured in the holder recesses 15*a* and 15*b* by tightening screws 16*a*, 16*b*, whereby the holder legs are fixed in the correct position, i.e. perpendicularly to the profiled tube *7c*. The holder is secured to a desired base 22 by tightening the screws 11*a*, 11*b* by means of the knobs 14*a*, 14*b*. The ski is now firmly secured to the support 22, with the ski stopper mechanism 6 in the retracted position, and it is ready for preparation (waxing, sharpening, etc.). Without any adjustment whatsoever of the attachment of the dummy to the ski or the fastening of the holder part 8 to the support surface 2, the ski can be shifted between three different positions, i.e. with the bottom side up (FIG. 1) or with either side edge up (FIG. 2). The only thing one has to do to shift between these positions is to loosen the clamping screws 16*a*, 16*b*, remove the intermediate portion *7c* from the recesses 15*a*, 15*b*, turn the dummy (with the attached ski) as desired, and again fasten the intermediate piece in the recesses 15*a*, 15*b* by means of the screws 16*a*, 16*b*.

The clamping piece 10 is preferably designed in the manner which is best seen in FIG. 5. In this embodiment the clamping piece is designed as an angle-iron having a first leg 10*a* and essentially perpendicularly thereto a second leg 10*b*. The guide sleeves 12*a*, 12*b* are secured to the leg 10*a*, whereas the leg 10*b* serves as clamping surface against the support surface 2. Set screws 24 extend through the leg 10*b* and preferably project from both sides thereof. The screws 24 can preferably be adjusted so that they project more or less from the leg surface 10*b*. By this design several important advantages are achieved. Thanks to the symmetry in relation to the holder legs 9*a*, 9*b* the clamping piece 10 can be placed either as shown in FIG. 3, i.e. with the leg 10*a* directed downwards from the clamping leg 10*b*, or else with the leg 10*a* directed upwards from the clamping leg 10*b*, by 180° turning of the clamping piece in relation to FIG. 3 and FIG. 5. In the latter case the clamping gap between the holder legs 9*a*, 9*b* and the clamping leg 10*b* increases (by about the width of the leg 10*a*), which makes it possible to adjust, by a simple manipulation, the holder for attachment to support surfaces of considerably varying thickness (the clamping gap is, of course, also effected by the length of the screws 11*a*, 11*b*). Thanks to the set screws 24 the holder can also with good result be clamped to non-planar, e.g. round supports, and the clamping effect can be adjusted by varying the portions of the screws 24 projecting from the surface 10*b*.

The invention is, of course, not limited to the embodiment specifically described above and shown in the drawings, but many variations and modifications are possible within the inventive idea and the subsequent claims.

What I claim is:

1. A holder for attaching skis having a binding including a ski-stopper mechanism to a stationary support, comprising:

(a) a ski boot dummy to be inserted into the binding correspondingly as a ski boot while retracting the ski stopper mechanism, (b) a holder part having means for attachment to said support and means for removably securing said ski boot dummy to said holder part, said means for attaching said ski boot dummy to said holder part permitting attachment of the dummy in a first position, in which the bottom side of the ski is turned upwards, and second and third positions, in which either of the side edges of the ski are turned upwards; wherein said ski boot dummy comprises (i) a front part corresponding to the toe portion of a ski boot, (ii) a rear part corresponding to the heel portion of a ski boot, and (iii) an intermediate part interconnecting said front part with said rear part, said intermediate part being arranged to be removably attached to said holder part;

(wherein at least one of said front and rear parts can be displaced along said intermediate part and can be secured thereto in positions corresponding to the desired binding size;

wherein said intermediate part is provided with longitudinal slots at at least one end thereof; and wherein the corresponding front or rear part can be removably secured to said intermediate part by means of elongate fastening means extending through said longitudinal slots.

2. A ski holder according to claim 1, wherein at least part of said intermediate part has substantially square cross-sectional shape, and wherein the attachment means of said holder part comprises two holder legs, one end of each holder leg comprising a recess for receiving said intermediate part of said dummy, said holder legs further having means for securing said intermediate part in said recesses.

3. A ski holder according to claim 2, wherein each of said holder legs comprises an internal thread cooperating with a corresponding screw for securing said holder part to said support, each of said screws freely passing through guide sleeves provided on a clamping piece extending substantially perpendicular to said screws, so that tightening of said screws into said internal threads cause clamping of said support between said clamping piece and those ends of said holder legs which are remote from said recesses.

4. A ski holder according to claim 3, wherein said clamping piece has the shape of an angle-iron, one shank of which is intended to be applied to said support.

5. A ski holder according to claim 4, wherein the clamping gap between said shank and said holder legs can be adjusted by turning said clamping piece 180° so that the opposite side of said shank is applied to said support.

* * * * *